US008305413B2

(12) United States Patent
Aoyama et al.

(10) Patent No.: US 8,305,413 B2
(45) Date of Patent: Nov. 6, 2012

(54) OPTICAL WRITING APPARATUS AND IMAGE FORMING APPARATUS, CONFIGURED TO INCLUDE SYNCHRONOUS DETECTOR

(75) Inventors: Takanori Aoyama, Miyagi (JP); Tomoyuki Murakami, Miyagi (JP); Yukio Kazama, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 446 days.

(21) Appl. No.: 12/570,028

(22) Filed: Sep. 30, 2009

(65) Prior Publication Data

US 2010/0103239 A1 Apr. 29, 2010

(30) Foreign Application Priority Data

Oct. 28, 2008 (JP) ..... 2008-276688

(51) Int. Cl.
*B41J 2/435* (2006.01)
*B41J 2/47* (2006.01)

(52) U.S. Cl. ..... 347/235; 347/250

(58) Field of Classification Search ..... 347/229, 347/234, 235, 248–250
See application file for complete search history.

(56) References Cited

U.S. PATENT DOCUMENTS 6,366,385 B2 * 4/2002 Kimura ..... 359/204.1
7,436,425 B2 * 10/2008 Yamazaki et al. ..... 347/244

FOREIGN PATENT DOCUMENTS

JP 11-95138 4/1999
JP 2005208662 A * 8/2005
JP 2007-148356 6/2007

* cited by examiner

*Primary Examiner* — Hai C Pham
(74) *Attorney, Agent, or Firm* — Cooper & Dunham LLP

(57) ABSTRACT

An optical scanner unit includes an LD unit, a polygon mirror deflecting a light beam, an optical scan system focusing the light beam from the polygon mirror on a photoconductive drum to form an electrostatic latent image, and a synchronous detector receiving a part of the light beam to detect a write start position on the photoconductive drum in main scan direction. The synchronous detector is fixed on a portion of a housing at predetermined angles in main and sub scan directions relative to an incidence angle of the light beam on the synchronous detector.

8 Claims, 5 Drawing Sheets

OPTICAL WRITING APPARATUS AND IMAGE FORMING APPARATUS, CONFIGURED TO INCLUDE SYNCHRONOUS DETECTOR

CROSS REFERENCE TO RELATED APPLICATION

The present application is based on and claims priority from Japanese Patent Application No. 2008-276688, filed on Oct. 28, 2008, the disclosure of which is hereby incorporated by reference in its entirety.

BACKGROUND OF THE INVENTION

1. Field of the Invention

The present invention relates to an optical scanner unit and an image forming apparatus incorporating the same such as a digital copier, a laser printer, or a laser facsimile machine.

2. Description of the Related Art

It is well known that such an image forming apparatus comprises an optical scanner unit which includes a light source made of laser diodes (hereinafter, LD) or the like and a deflector to deflect a light beam from the light source to scan the surface of an image support member with the light beam and generate an electrostatic latent image. The optical scanner unit of this type includes a synchronous detector which receives a part of the light beam deflected by the deflector when scanning, detects a write start position in main scan direction on the image support member, and feeds back the detected information to control the LD.

However, there is a problem in the prior art optical scanner unit that the light source may fail to regularly emit a light beam due to incidence of light on the LD which has been reflected by the light receiving face of the synchronous detector or a case thereof. This may cause a problem of generation of non-normal images.

In order to solve the problem, Japanese Unexamined Patent Application Publication No. Hei 11-95138 proposes an optical scanner unit which is configured to include a housing with a convex to position a synchronous detector and a circuit board with a concave on which a synchronous detector is mounted so that the synchronous detector is fitted into the housing.

In this optical scanner unit, the synchronous detector can be positioned securely, however, it is still possible for a light beam reflected by the synchronous detector to be incident on the LD since the angle at which the synchronous detector is fixed is not restricted.

Japanese Unexamined Patent Application Publication No. 2007-148356 discloses another optical scanner unit which is configured to control the LD not to turn on when a light beam from the LD is incident on the mirror face of the deflector at 90 degree angle, thereby preventing a returning light from the deflector from being incident on the LD.

However, there still remains a possibility that a returning light from the synchronous detector may be incident on the LD immediately before turning-off of the LD since the angle at which the synchronous detector is fixed to the housing is not restricted.

SUMMARY OF THE INVENTION

The present invention aims to provide an optical scanner unit and an image forming apparatus which can maintain normal operation of a synchronous detector and prevent a returning light therefrom being incident on a light source.

According to one aspect of the present invention, an optical scanner unit comprises a light source; a deflector which deflects a light beam from the light source; an optical scan system which includes an fθ lens and focuses the light beam deflected by the deflector on an image support member to form an electrostatic latent image; and a synchronous detector which receives a part of the light beam deflected by the deflector and detects a write start position on the image support member in a main scan direction, wherein the synchronous detector is fixed at predetermined angles in main and sub scan directions of the optical scanner unit relative to an incidence angle of the light beam on the synchronous detector.

In one features of the above aspect, the angle at which the synchronous detector is fixed in the main scan direction is determined to satisfy the following condition (1):

$$\theta 1-|3\theta 2|\geqq 0$$

where θ1 is an angle between a first straight line connecting a beam reflecting point of the deflector and a point of an electrostatic latent image at image height of 0 mm and a second straight line connecting an exit point of an optical axis from the fθ lens to be incident on the synchronous detector in the main scan direction and a light receiving point of the synchronous detector, and θ2 is an angle between the second straight line and a normal line of the synchronous detector.

In other features of the above aspect, the angle at which the synchronous detector is fixed in the sub scan direction is determined to satisfy the following condition (2):

$$\theta 2>\theta 3$$

where θ3 is an angle between a third straight line connecting an exit point of the light beam from the fθ lens to be incident on the synchronous detector in the sub scan direction and a light receiving point of the synchronous detector and a normal line of the synchronous detector.

In other features of the above aspect, the optical scanner unit further comprises a housing accommodating the detector and the optical scan system and having a portion on which the synchronous detector is fixed.

In other features of the above aspect, the portion on which the synchronous detector is fixed is processed at a predetermined precision in order to securely fix the synchronous detector on the portion without a gap.

In other features of the above aspect, the housing comprises, on the portion, a structure to determine a position of the synchronous detector and fix the synchronous detector.

According to another aspect of the present invention, an image forming apparatus comprises the above-described optical scanner unit to form an electrostatic latent image on an image support member.

PREFERRED EMBODIMENT OF THE INVENTION

Hereinafter, embodiments of the present invention will be described in detail with reference to the accompanying drawings. The following description of the preferred embodiments is merely exemplary in nature and is in no way intended to limit the invention, its application, or uses.

Figure 1:
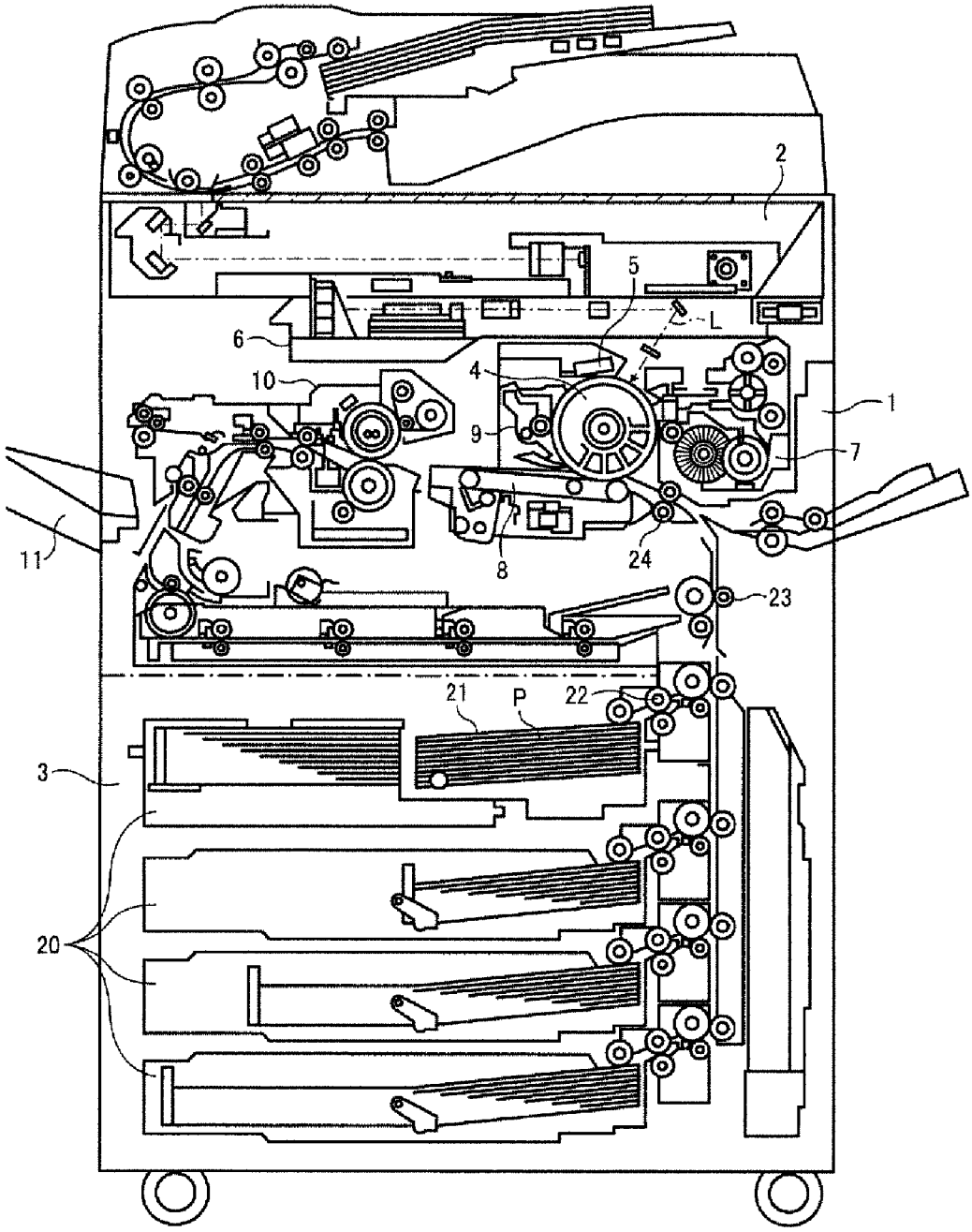
FIG. 1 is a vertical cross sectional view of an example of an image forming apparatus according to the present invention.

FIG. 1 shows an example of an image forming apparatus which includes an optical scanner unit 6 according to the present embodiment, an imaging unit about a center of the apparatus, a document reader 2 above the imaging unit reading a document, and a feeder unit 3 at the bottom feeding print media.

The imaging unit includes a photoconductive drum 4 as an image support member, an electric charger 5, a develop unit 7 and else. The photoconductive drum 4 is rotated clockwise in FIG. 1 in imaging operation and the surface thereof is uniformly charged by the electric charger 5 at a predetermined polarity. A charged portion of the surface is radiated with a light beam L from the optical scanner unit 6 which is optically converted from signals in accordance with image information read by the document reader 2, to thereby form an electrostatic latent image on the photoconductive drum 4. The electrostatic latent image is visualized to be a toner image by the develop unit 7.

The feeder unit 3 comprises a plurality (four in the drawing) of feeders 20 each of which includes a print tray 21 containing print media made of paper, resin film or else and a feed roller 22. The feed roller 22 is rotated in contact with the topmost print medium P to emit the topmost print medium from the print tray 21 of a selected feeder 20.

The emitted print medium P is transported upwards in FIG. 1 via a transport roller 23 and temporarily stopped at a resist roller pair 24. The resist roller pair 24 is started to rotate at a predetermined timing to transport the print medium P to the photoconductive drum 4. Thereby, a toner image on the photoconductive drum 4 is transferred to the print medium P by a transfer unit 8. Thus, the resist roller pair 24 functions to transmit the print medium P to the photoconductive drum 4 at a right timing so as to transfer a toner image on the photoconductive drum to the print medium P.

The transfer unit 8 functions to transfer a toner image on the photoconductive drum 4 to the print medium P transported from the resist roller pair 24. Various kinds of members can be used for the transfer unit 8. In the present embodiment, the transfer unit 8 is composed of a plurality of support rollers and a transfer belt extending over the support rollers.

After transfer of the toner image, remaining toner on the photoconductive drum 4 is removed by a cleaner unit 9 and a potential on the surface thereof is neutralized by a not-shown neutralizer.

The print medium P is transported to the transfer belt and enters a fuser unit 10 which fuses the toner image on the print medium P. Having passed the fuser unit 10, the print medium is discharged and stacked on a tray 11.

As described above, an image is formed on one side of the print medium P. The image forming apparatus is configured to form a toner image on the other side of the print medium P, however, double-sided image forming is not the main feature of the present invention, therefore, a description thereof will be omitted.

Figure 2:
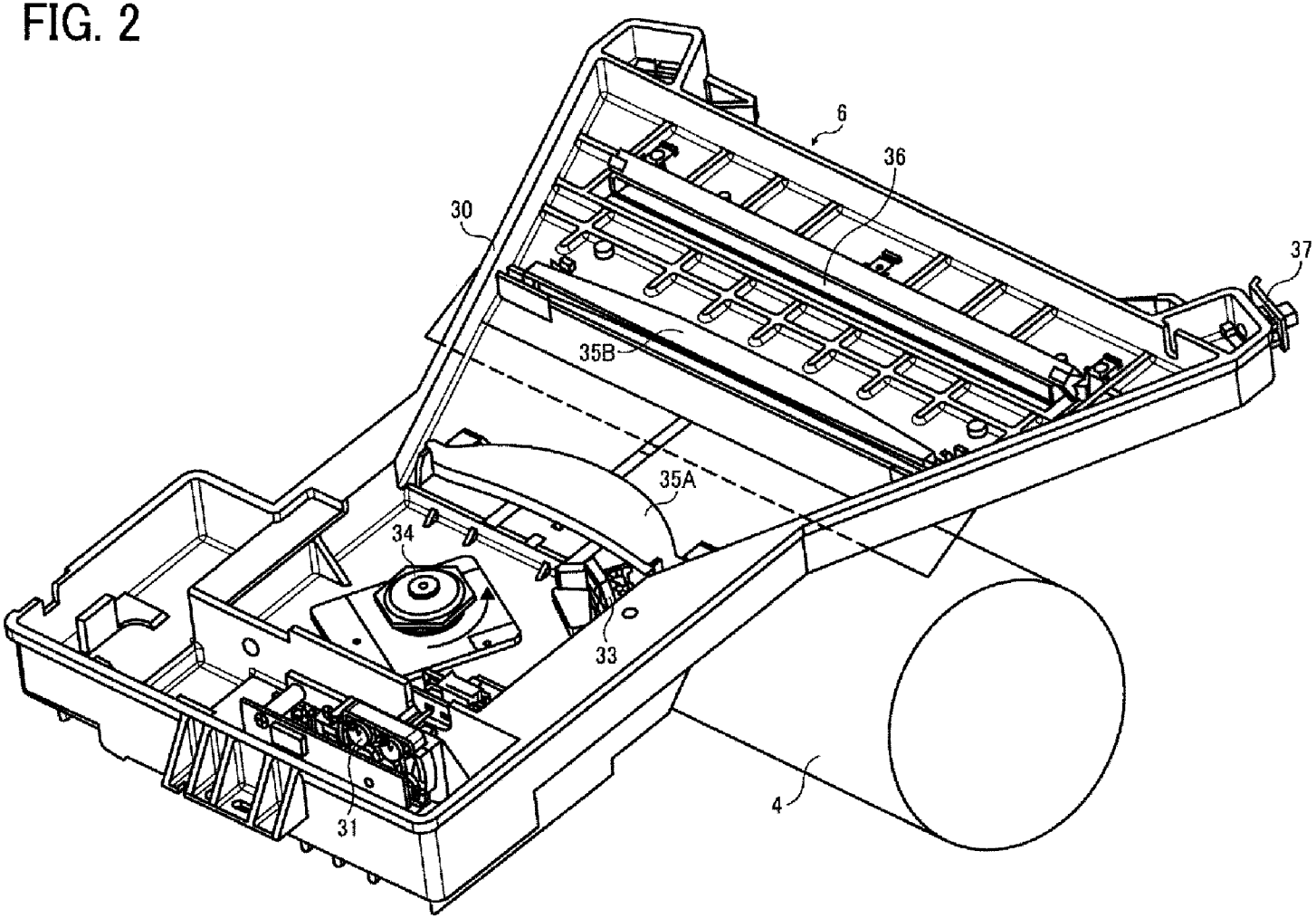
FIG. 2 is a perspective view of an inner structure of an optical scanner unit according to one embodiment of the present invention.
Figure 3:
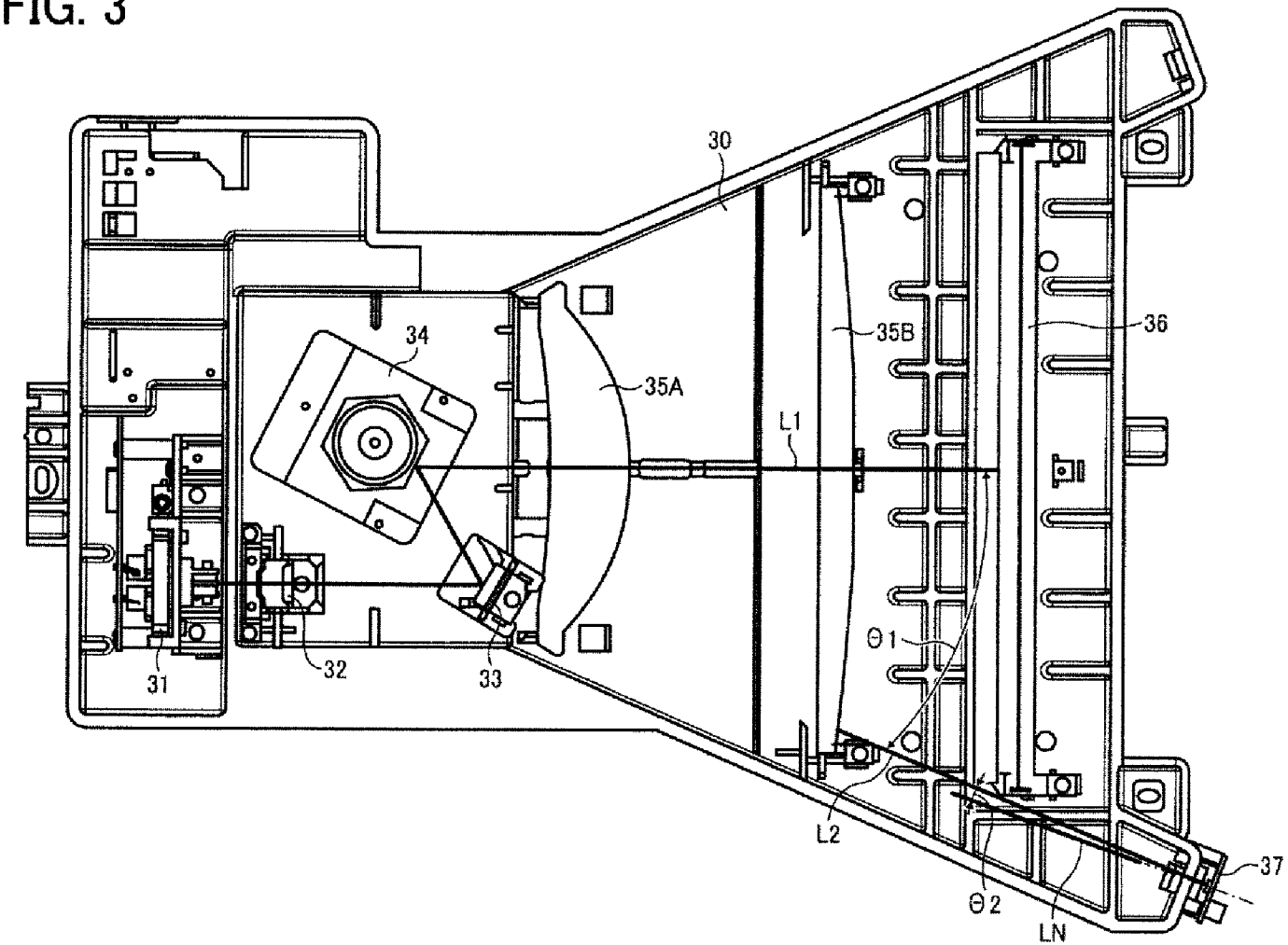
FIG. 3 is a plain view of the optical scanner unit in FIG. 2.

FIG. 2 is a perspective view of an inner structure of the optical scanner unit 6 according to one embodiment of the present invention while FIG. 3 is a plain view of the optical scanner unit in FIG. 2. In FIG. 2 the optical scanner unit 6 comprises a housing 30, an LD unit 31, a cylindrical lens 32, a first mirror 33, a polygon mirror 34, an optical scan system of two fθ lenses 35A, 35B, and a second mirror 36. In the optical scanner unit 6, a light beam from the LD unit 31 passes through the cylindrical lens 32 and is reflected by the first mirror 33 to be guided to the polygon mirror 34. Having been reflected by the polygon mirror 34, the light beam passes through the fθ lenses 35A, 35B and radiates the photoconductive drum 4 via the second mirror 36 to form an electrostatic latent image on the photoconductive drum surface.

The optical scanner unit 6 comprises a synchronous detector 37 to receive the light beam deflected by the polygon mirror 34 outside the scan area of the photoconductive drum 4. The synchronous detector 37 is disposed in a right bottom portion of the housing 30 in FIG. 3 according to the present embodiment to receive the light beam with the same distance from the LD unit 31 as the photoconductive drum 4 does. The synchronous detector 37 is configured to receive a part of the light beam deflected by the polygon mirror 34 at every line-scanning on the surface of the photoconductive drum 4 to detect a write start position thereon in the main scan direction and feed back detected information to control the LD unit 31.

Next, a structure to fix the synchronous detector 37 is described with reference to FIG. 4 and FIG. 5. A portion of the housing 30 on which the synchronous detector 37 is fixed is formed to include a positioning pin 38 and a screw hole 39. One end of the synchronous detector 37 is inserted into the positioning pin 38 while the other end thereof is screwed with a not-shown screw through the screw hole 39.

For attaching the synchronous detector 37 to the housing 30, it is necessary to position the synchronous detector 37 in a range of angles to be able to reliably detect the light beam and prevent the light beam reflected by the synchronous detector 37 from being incident on the LD unit 31.

In order to achieve this, the inventors of the present invention have found, through various tests and experiments, the right angles to fix the synchronous detector 37 in both the main and sub scan directions at which the synchronous detector 37 can reliably detect the light beam and prevent the light beam (returning light) reflected by the synchronous detector 37 or the case 37B from being incident on the LD unit 31. The angle to fix the synchronous detector 37 in the main scan direction is obtained by the following condition (1):

$$\theta 1-|3\theta 2|\geqq 0$$

where θ1 in FIG. 3 is an angle between a straight line L1 connecting a beam reflecting point of the polygon mirror 34 and a point of an electrostatic latent image at image height of 0 mm and a straight line L2 connecting an exit point of an optical axis from the fθ lens 35B to be incident on the light receiving face 37A of the synchronous detector 37 in the main scan direction and a light receiving point of the synchronous detector 37, and θ2 in FIG. 3 is an angle between the straight line L2 and a normal line LN of the synchronous detector 37.

Figure 4:
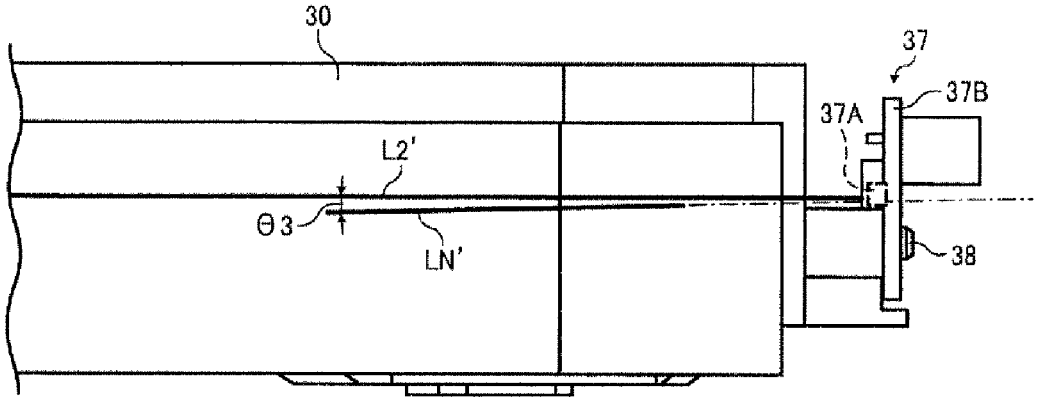
FIG. 4 is a side view of the optical scanner unit showing a synchronous detector mounted thereon.

The angle to fix the synchronous detector 37 in the sub scan direction is obtained by the following condition (2):

$$\theta 2>\theta 3$$

where θ3 in FIG. 4 is an angle between a straight line L2' connecting an exit point of the light beam from the fθ lens 35B to be incident on the light receiving face 37A of the synchronous detector 37 in the sub scan direction and a light receiving point of the synchronous detector 37 and a normal line LN' of the synchronous detector 37.

Accordingly, shifting the angles to fix the synchronous detector 37 in the main and sub scan directions from the incidence angle of the light beam thereon as above makes it possible for the synchronous detector 37 to detect the light beam without failure and prevent the returning light from the synchronous detector 37 or the case 37B from being incident on the LD unit 31.

Figure 5:
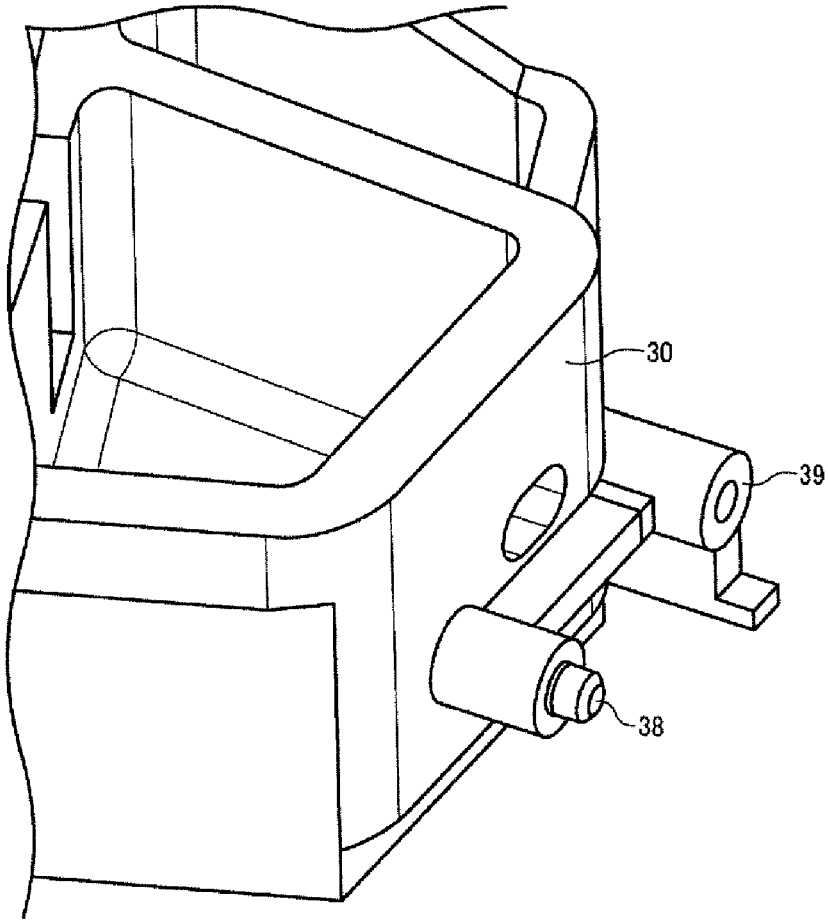
FIG. 5 is a perspective view of a portion of a housing of the optical scanner unit on which the synchronous detector is mounted.

FIG. 5 shows the structure of the portion of the housing 30 on which the synchronous detector 37 is to be fixed. The receiving faces of the positioning pin 38 and the screw hole 39 are machined with a predetermined precision by secondary processing to be able to securely fix the synchronous detector 37 thereon without a gap. This makes it possible for the image forming apparatus to output images with little variation in write start position.

Figure 6:
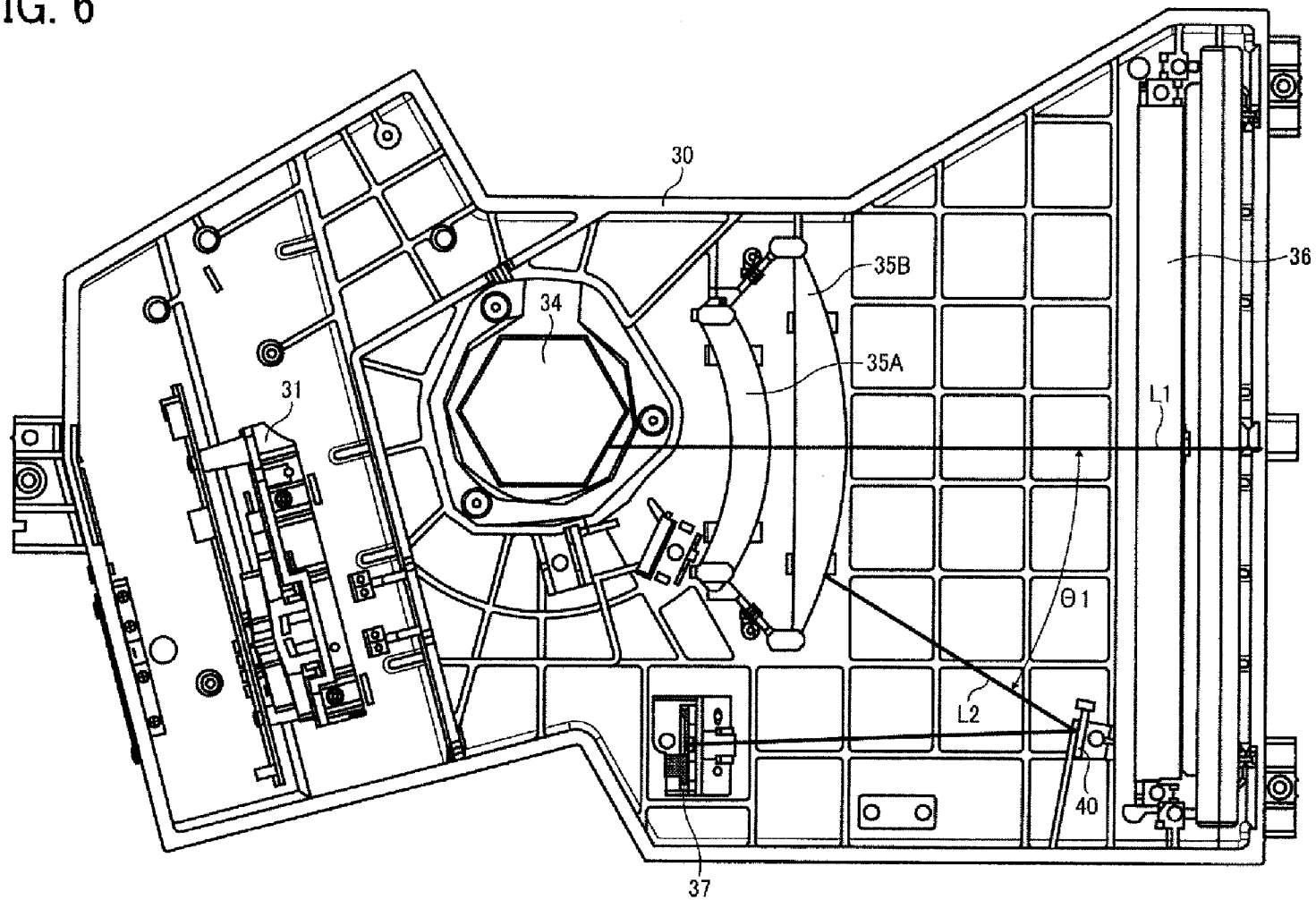
FIG. 6 is a plain view of an inner structure of an optical scanner unit according to another embodiment of the present invention.

FIG. 6 is a plain view of an example of an optical scanner unit 6 according to another embodiment of the present embodiment which is configured to include a reflective mirror to return a light beam and guide it to the synchronous detector 37 for the purpose of saving a space or the like.

Also, in the present embodiment, the synchronous detector 37 can be fixed at predetermined angles in the main and sub scan directions to satisfy the condition (1), where θ1 is an angle between a straight line L1 connecting a beam reflecting point and a point of an electrostatic latent image at image height of 0 mm and a straight line L2 connecting an exit point of an optical axis from the fθ lens 35B to be incident on the light receiving face 37A of the synchronous detector 37 and a reflecting point of the reflective mirror 40.

According to the present invention, the synchronous detector is disposed at predetermined angles in the main and sub scan directions so as not to reflect the light beam to the LD unit so that it is able to reliably prevent the returning light to the LD unit and the image forming apparatus incorporating this optical scanner unit can output images formed at accurate write start position.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. An optical scanner unit comprising:

a light source;

a deflector which deflects a light beam from the light source;

an optical scan system which includes an fθ lens and focuses the light beam deflected by the deflector on an image support member to form an electrostatic latent image; and a synchronous detector which receives a part of the light beam deflected by the deflector and detects a write start position on the image support member in a main scan direction, wherein a light beam receiving face of the synchronous detector is shifted from an orientation that is normal to a direction of the part of the light beam received by the synchronous detector by predetermined non-zero angles θ2 and θ3 in planes generally aligned with the main and sub scan directions, respectively, of the optical scanner unit, wherein a second straight line connecting an exit point of an optical axis from the fθ lens to be incident on the synchronous detector in the main scan direction and a light receiving point of the synchronous detector, θ2 is an angle between the second straight line and a normal line of the synchronous detector, where θ3 is an angle between a third straight line connecting an exit point of the light beam from the fθ lens to be incident on the synchronous detector in the sub scan direction and a light receiving point of the synchronous detector and a normal line of the synchronous detector and the angle θ3 is determined to satisfy the following condition (2):

$$\theta 2>\theta 3.$$

2. An optical scanner unit according to claim 1, wherein the angle θ2 is determined to satisfy the following condition (1):

$$\theta 1-|3\theta 2|\geqq 0$$

where θ1 is an angle between a first straight line connecting a beam reflecting point of the deflector and a point of formation of an electrostatic latent image at image height of 0 mm and the direction of the part of the light beam received by the synchronous detector.

3. An optical scanner unit according to claim 1, further comprising a housing accommodating the detector and the optical scan system and having a portion on which the synchronous detector is fixed.

4. An optical scanner unit according to claim 3, wherein the portion on which the synchronous detector is fixed is processed at a predetermined precision in order to securely fix the synchronous detector on the portion.

5. An optical scanner unit according to claim 3, wherein the housing comprises on the portion, a structure to orient the fixed synchronous detector such that the light beam receiving face of the synchronous detector is shifted from the orientation that is normal to the direction of the part of the light beam received by the synchronous detector by the predetermined non-zero angles θ2 and θ3.

6. An image forming apparatus comprising an optical scanner unit according to claim 1 to form an electrostatic latent image on an image support member.

7. An optical scanner unit according to claim 1 wherein a distance that the part of the light beam travels to reach the synchronous detector from the light source is substantially the same as a distance that the light beam travels from the light source to a point of formation of an electrostatic latent image on the image support member.

8. An optical scanner unit according to claim 1 wherein an amount of the part of the light beam received by the synchronous detector reflects from the light receiving face of the synchronous detector along a reflection path which does not strike the light source.

* * * * *